United States Patent [19]

Corth

[11] 4,371,810

[45] Feb. 1, 1983

[54] PLANT GROWTH TYPE FLUORESCENT LAMP

[75] Inventor: Richard Corth, Nutley, N.J.

[73] Assignee: Westinghouse Electric Corp., Pittsburgh, Pa.

[21] Appl. No.: 146,888

[22] Filed: May 5, 1980

[51] Int. Cl.[3] ..... H01J 1/62; H01J 63/04

[52] U.S. Cl. ..... 313/487

[58] Field of Search ..... 313/487; 252/301.48

[56] References Cited

U.S. PATENT DOCUMENTS

| | | | |
|---|---|---|---|
| 3,748,517 | 7/1973 | Haft | 313/487 |
| 4,199,707 | 4/1980 | Akiyama et al. | 313/487 |
| 4,263,530 | 4/1981 | Broekhoven et al. | 313/487 |

*Primary Examiner*—Bruce C. Anderson

*Attorney, Agent, or Firm*—W. D. Palmer

[57] ABSTRACT

A luminescent discharge lamp to efficiently stimulate balanced undistorted plant growth, the lamp emitting radiation having a spectral energy distribution such that the energy in the 400–500 nanometer (nm), 590–640 nm, 640–690 nm, and 690–800 nm bands are approximately in proportions of 1:2.6:1.3:1.2. The enumerated spectral energy distribution provides for a very high plant growth rate with balanced plant growth. Preferably, the lamp comprises a band-emitting phosphor blend consisting essentially of about 95% by weight stannous tin activated strontium calcium magnesium orthophosphate and about 5% by weight of divalent europium activated strontium chloroapatite and phosphor having a line emission concentrated at 610 nanometer consisting essentially of trivalent europium activated yttrium oxide.

5 Claims, 2 Drawing Figures

PLANT GROWTH TYPE FLUORESCENT LAMP

BACKGROUND OF THE INVENTION

The present invention relates to fluorescent lamps for stimulating the growth of plants.

Generally, it is desirable that the lamp stimulate the plant to approximately balanced plant growth rather than for example relatively long and thin plants which can be produced by improper blue to red ratios, high growth rate (generally measured by the rate of increase of dry weight of the plant) and efficiency, (typically measured by the amount of increase of dry weight per watt of input). It has been realized that while balanced plant growth can be obtained by a lamp whose spectral distribution duplicates sun light, that such a lamp would be very inefficient as light would be supplied which would not be used and thus would be wasted energy. The green light for example is generally reflected rather than absorbed. Thus a plant growth lamp should provide the proper ratios of energy in the portions of the spectrum which effect plant growth but should not waste energy in the portions of the spectrum which do not effect plant growth.

One type of plant growth illumination system which is commonly used is a combination of Cool White fluorescent lamps and incandescent lamps. This combination has been found to be quite productive for plant growth, but has disadvantages due to the use of the incandescent lamps. The incandescent lamps are shorter lived and expend a large amount of their energy in unused infrared radiation.

The illumination systems using only fluorescent lamps have also been used. One such growth lamp is described in U.S. Pat. No. 3,287,586, issued to E. D. Bickford on Nov. 22, 1966. This patent teaches that wide ranges of ratios of energy in the spectral regions of red to far red are acceptable. It also teaches relatively specific ratios in the spectral regions and the use of lead-intensified calcium tungstate blended with tin activated strontium orthophosphate.

Another fluorescent plant growth system is taught in British Pat. No. 1,231,633, issed May 12, 1971, to E. D. Bickford. This patent also teaches that a wide range in the ratio of red to far red is acceptable. This patent teaches a blend of tin activated strontium calcium magnesium orthophosphate with maganese activated magnesium fluorogermanate, with the fluorescent radiation in the blue and violet being negligible, the blue and violet radiation from the lamp deriving substantially entirely from the mercury discharge.

Another plant growth system is taught in U.S. Pat. No. 3,992,646, issued Nov. 16, 1976, to Richard Corth. This patent teaches that a lamp having a spectral energy distribution such that the energy in the 400–500 nanometer (nm) blue range, 590–640 nm orange range, 640–690 nm red range, and the 690–800 nm far red range be within approximately the proportions of 0.8:1:1:1 to produce plant growth rates dramatically higher than the growth rate of prior art lamps.

SUMMARY OF THE INVENTION

It has been discovered that the addition of energy in a line emission concentrated at about 610 nm to the lamp of the aforesaid Corth patent results in improved balanced plant growth and produces a significant enhancement of growth efficiency. The instant invention calls for a spectral energy distribution such that the energy in the 400–500 nm blue range, the 590–640 nm orange-red range, the 640–690 nm red range and the 690–800 nm far red-infrared range be within about 15% of being within the proportions of 1:2.6:1.3:1.2. The lamp of this invention comprises phosphor means comprising predetermined amounts of a band-emitting phosphor blend principally comprising tin-activated strontium calcium magnesium orthophosphate and a band-emitting phosphor principally emitting in the 400–500 nm range, and the phosphor means also includes phosphor having a line emission concentrated at about 610 nm.

BRIEF DESCRIPTION OF THE DRAWINGS

For a better understanding of the invention, reference may be had to the preferred embodiment, exemplary of the invention, shown in the accompanying drawings in which.

DESCRIPTION OF THE PREFERRED EMBODIMENTS

Figure 1:
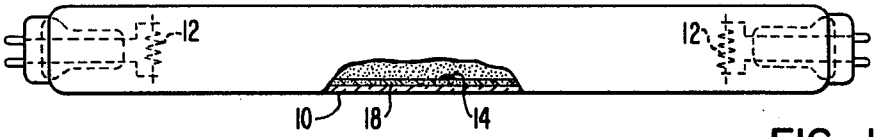
FIG. 1 is an elevational view partly in section of a balanced-plant-growth-stimulating low-pressure mercury-discharge lamp.

While other types of discharge lamps such as a high pressure mercury lamp can be used to energize phosphors to provide the desired spectral energy distribution, a low pressure mercury discharge lamp is preferred. With reference to FIG. 1, there is shown a low pressure mercury vapor fluorescent lamp, wherein a conventional, elongated, tubular, soda-lime glass envelope 10 has operative discharge-sustaining electrodes 12 at opposite ends. The discharge-sustaining material comprises mercury 14 and an inert starting gas filling as is well known in the art. A phosphor layer 18 is disposed on the interior surface of the envelope 10. In such a configuration, the phosphor layer 18 is the primary light generating medium and the electrodes 12 together with the discharge sustaining material 14 comprise means for producing a low-pressure mercury discharge within the envelope 10. The mercury discharge energizes the phosphor layer 18 to a light generating condition. The principal combined emissions of the phosphor layer 18 and the visible emissions of the discharge pass through the envelope 10 have a spectral energy distribution such that the energy in the 400–500 nm, 590–640 nm, 640–690 nm and 690–800 nm ranges are at least within about 15% of being within the proportions of 1:2.6:1.3:1.2. This can also be expressed as in the following Table I:

TABLE I

| Wavelengths | Ratio | Equivalent Percentages | Plus or Minus 15% |
|---|---|---|---|
| 400–500 nm | 1 | 16.4 | 13.9 to 18.9% |
| 590–640 nm | 2.6 | 42.6 | 36.2 to 50% |
| 640–690 nm | 1.3 | 21.3 | 18.1 to 24.5% |
| 690–800 nm | 1.2 | 19.7 | 16.7 to 22.7% |
| | 6.1 | 100.0 | |

Lamps with the foregoing proportions of emission provide a significant enhancement of growth efficiency and a balanced plant growth comparable to growth under high light intensities. In tests in which dry tomato plant weight was measured, the use of the lamp of the instant invention gave 50% more tomato plant weight than the lamp taught by the aforesaid U.S. Pat. No. 3,992,646, issued to Corth.

For best performance the spectral distribution should be even more closely defined. It is preferable that the spectral energy distribution be within about 10% of the following values: 12% in the 400–500 nm range; 8% in the 500–550 nm range; 20% in the 550–590 nm range; 31% in the 590–640 nm range; 15% in the 640–690 nm range; and 14% in the 690–800 nm range. This can also be expressed as in the following Table II:

TABLE II

| Wavelengths | Percentages | Plus or Minus 10% |
|---|---|---|
| 400–500 nm | 12% | 10.8 to 13.2% |
| 500–550 nm | 8% | 7.2 to 8.8% |
| 550–590 nm | 20% | 18 to 22% |
| 590–640 nm | 31% | 27.9 to 34.1% |
| 640–690 nm | 15% | 13.5 to 16.5% |
| 690–800 nm | 14% | 12.6 to 15.4% |

It should be noted that the energy emission levels in the 500–550 nm range and 550–590 nm range are less critical than the others, but are still important for plant growth.

One embodiment of the lamp of this invention is with phosphor means comprising predetermined amounts of a band-emitting phosphor blend principally comprising stannous-tin-activated strontium calcium magnesium orthophosphate and a band-emitting phosphor principally emitting in the 400–500 nm blue range. The phosphor means also includes phosphor having a line emission concentrated at about 610 nm to attain a spectral energy distribution such that the energy in the 400–500 nm, 590–640 nm, 640–690 nm and 690–800 nm ranges are at least within about 15% of being within the proportions of 1:2.6:1.3:1.2. Preferably, the band-emitting phosphor blend consists essentially of about 95% by weight, tin-activated strontium calcium magnesium orthophosphate and about 5% by weight, divalent europium activated strontium chloroapatite, and the 610 nm line emitting phosphor consists essentially of trivalent europium activated yttrium oxide. Preferably, the weight ratio of the band-emitting phosphor blend to the phosphor having a line emission concentrated at about 610 nm is from about 87:13 to 75:25. The best results were obtained when the phosphor means consisted essentially of about 82% by weight of the band-emitting phosphor blend and about 18% by weight of the 610 nm line emitting phosphor.

The strontium chloropatite composition $Sr_5(PO_4)_3Cl$: $Eu^{2+}$ can be prepared by firing a raw mix containing about 2 moles of $SrCO_3$, 3 moles $SrHPO_4$, 1.2 moles of $NH_4Cl$, and 0.025 mole of $Eu_2O_3$ at about 1,100° C. in a $N_2$ atmosphere for about 1 hour. The tin activated strontium calcium magnesium orthophosphate phosphor can be prepared by firing a raw mix containing about 2.3 moles of SrO, 1.0 mole of $P_2O_6$, 0.027 mole of SnO, 0.3 mole of MgO, and 0.300 mole of CaO at about 1150° C. in a 95% $N_2$-5% $H_2$ atmosphere for about 2 hours. The trivalent europium activated yttrium oxide phosphor can be prepared by firing a raw mix containing about 0.48 mole of $Y_2O_3$, 0.03 mole of $Eu_2O_3$, and 0.025 mole of $CaF_2$ at about 1300° C. in air for about 1 hour.

Although the strontium chloroapatite is the preferred host material for the divalent europium, other host materials such as aluminosilicate can also be used. Other activators and blue emitting phosphors such as terbium activated yttrium phosphate can also be used. Similarly, although the preferred embodiments used tin-activated strontium calcium magnesium orthophosphate, other phosphors such as tin-activated strontium magnesium phosphate can also be used, especially when supplemented by a phosphor emitting generally in the 690–800 nm far red range such as iron activated lithium metaaluminate (as well as a blue emitting phosphor) to provide proper proportions of spectral energy distribution. Also, other phosphors such as trivalent europium activated calcium oxide can be used as the phosphor emitting principally at about 610 nm.

Figure 2:
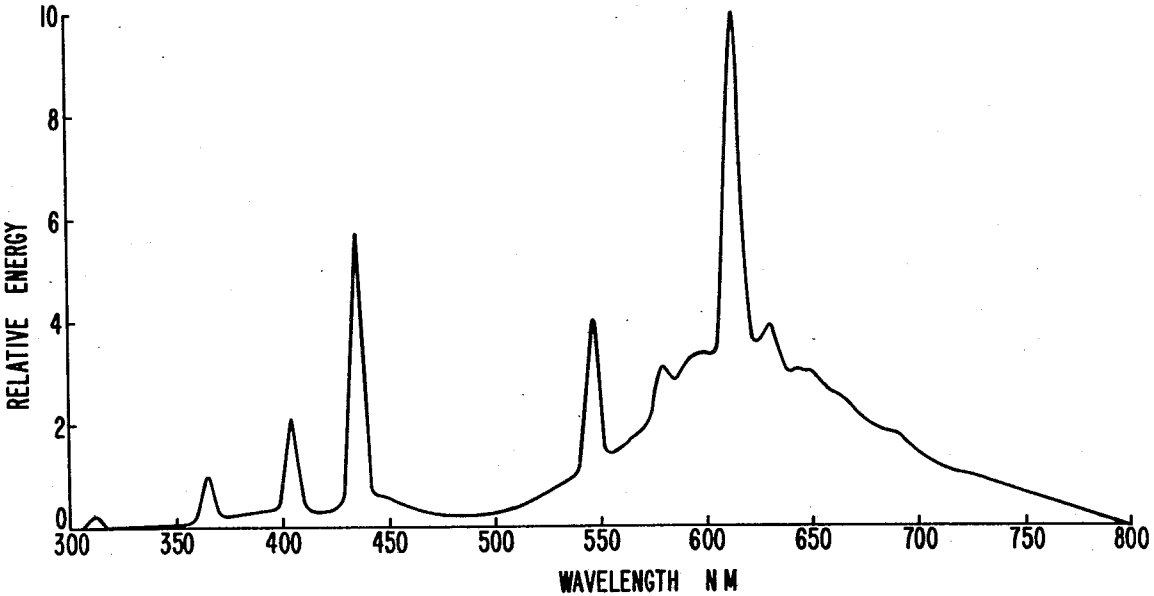
FIG. 2 is a graph of the spectral energy distribution of the preferred embodiment, showing the relative energy emitted at various wavelengths.

With reference to FIG. 2, there is shown the spectral power distribution for a 40 watt fluorescent plant growth lamp of the present invention with a phosphor means utilizing a band-emitting phosphor blend consisting essentially of 5% by weight divalent europium activated strontium chloroapatite, and 95% by weight stannous-tin-activated strontium calcium magnesium orthophosphate and trivalent europium activated yttrium oxide as the 610 nm line emitting phosphor trivalent europium activated yttrium oxide with the yttrium oxide being 18% by weight of the phosphor means. As shown in FIG. 2, the lamp emission energies are principally confined to the 400–500 nm, 550–640 nm, 640–690 nm and 690–800 nm bands in the proportional ratios as specified, with a minor percentage of the total emission radiations located in the 500–550 nm and 550–590 nm bands in the percentages as specified hereinbefore. This lamp gave an increase in dry weight production of tomato plants of more than 50% compared to the lamp disclosed in the aforesaid U.S. Pat. No. 3,992,646, issued to Corth.

I claim:

1. A luminescent discharge lamp to efficiently stimulate balanced plant growth, said lamp comprising an elongated light-transmitting envelope, phosphor means as the primary light-generating media coated on the interior surface of said envelope, and means for producing a low-pressure mercury discharge within said envelope to energize said phosphor means to a light-generating condition, said phosphor means when energized exhibiting a predetermined emission spectrum, and the combined emissions of said phoshor means and the visible emissions from said discharge which pass through said envelope having a spectral energy distribution such that the emission energies are principally confined to the 400–500 nm, 590–640 nm, 640–690 nm, and 690–800 nm bands and within these bands are at least within about 15% of being within the proportions of 1:2.6:1.3:1.2 which can also be expressed as in the following table:

| Wavelengths | Ratio | Equivalent Percentages | Plus or Minus 15% |
|---|---|---|---|
| 400–500 nm | 1 | 16.4 | 13.9 to 18.9% |
| 590–640 nm | 2.6 | 42.6 | 36.2 to 50% |
| 640–690 nm | 1.3 | 21.3 | 18.1 to 24.5% |
| 690–800 nm | 1.2 | 19.7 | 16.7 to 22.7% |
| | 6.1 | 100.0 | |

2. The lamp of claim 1 wherein the spectral energy distribution is such that the relative energy is as expressed in the following table:

| Wavelengths | Percentages | Tolerances — Plus or Minus 10% |
|---|---|---|
| 400–500 nm | 12% | 10.8 to 13.2% |
| 500–550 nm | 8% | 7.2 to 8.8% |
| 550–590 nm | 20% | 18 to 22% |
| 590–640 nm | 31% | 27.9 to 34.1% |
| 640–690 nm | 15% | 13.5 to 16.5% |
| 690–800 nm | 14% | 12.6 to 15.4% |

3. The lamp of claim 1, wherein said phosphor means comprises predetermined amounts of a band-emitting phosphor blend principally comprising stannous-tin-activated strontium calcium magnesium orthophosphate and a band-emitting phosphor principally emitting in the 400–500 nm range, and said phosphor means also including phosphor having a line emission concentrated at about 610 nm to attain said spectral energy distribution of at least within about 15% of being within said proportions of 1:2.6:1.3:1.2.

4. The lamp of claim 3, wherein said band-emitting phosphor blend consists essentially of about 95% by weight of stannous tin activated strontium calcium magnesium orthophosphate and about 5% by weight of divalent europium activated strontium chloroapatite and said phosphor having a line emission concentrated at about 610 nm consists essentially of trivalent europium activated yttrium oxide, and wherein the ratio by weight of said band-emitting phosphor blend to said line-emitting phosphor is from about 87:13 to 75:25.

5. The lamp of claim 4, wherein said phosphor means consists essentially of about 82% by weight of said band-emitting phosphor blend and about 18% by weight of said line-emitting phosphor.

* * * * *